US006691795B2

(12) United States Patent
L'Abbe

(10) Patent No.: US 6,691,795 B2
(45) Date of Patent: Feb. 17, 2004

(54) SNOW OR SOIL GRADER

(75) Inventor: John L'Abbe, Leaf Rapids (CA)

(73) Assignee: Tri-Track International Ltd., Leaf Rapids (CA)

( * ) Notice: Subject to any disclaimer, the term of this patent is extended or adjusted under 35 U.S.C. 154(b) by 0 days.

(21) Appl. No.: 10/135,446

(22) Filed: May 1, 2002

(65) Prior Publication Data

US 2002/0162669 A1 Nov. 7, 2002

(30) Foreign Application Priority Data

May 7, 2001 (CA) ..... 2346574

(51) Int. Cl.[7] ..... E02F 3/76

(52) U.S. Cl. ..... 172/787; 172/786; 172/811; 180/9.1

(58) Field of Search ..... 172/781, 786, 172/787, 788, 811; 180/9, 9.21, 9.1, 9.3, 9.44, 9.46, 9.5, 184, 185, 190, 192; 280/5.22, 5.52

(56) References Cited

U.S. PATENT DOCUMENTS

| | | | | |
|---|---|---|---|---|
| 3,656,557 A | | 4/1972 | Eskelson et al. | |
| 3,741,331 A | * | 6/1973 | Kowalik | 180/9.44 |
| 3,747,718 A | * | 7/1973 | Gauchet | 180/9.1 |
| 3,789,942 A | * | 2/1974 | Kowalik | 180/9.44 |
| 3,900,077 A | * | 8/1975 | Gee et al. | 180/9.46 |
| 4,041,623 A | * | 8/1977 | Miller et al. | 37/382 |
| 4,174,757 A | * | 11/1979 | Stedman | 172/292 |
| 4,202,118 A | | 5/1980 | Held | |
| 4,789,266 A | * | 12/1988 | Clarke et al. | 404/96 |
| 4,802,293 A | * | 2/1989 | Smith | 37/381 |
| 5,113,958 A | * | 5/1992 | Holden | 180/9.4 |
| 5,451,135 A | * | 9/1995 | Schempf et al. | 414/694 |
| 5,555,944 A | * | 9/1996 | Kimoto | 172/787 |
| 5,573,071 A | | 11/1996 | Wilson et al. | |
| 5,918,682 A | * | 7/1999 | Fan et al. | 172/2 |
| 6,163,987 A | * | 12/2000 | Schommer | 37/407 |
| 6,276,758 B1 | * | 8/2001 | Hoffmann et al. | 180/89.15 |
| 6,431,299 B1 | * | 8/2002 | Asche et al. | 180/68.1 |
| 6,481,923 B1 | * | 11/2002 | Casters | 404/104 |

FOREIGN PATENT DOCUMENTS

| | | |
|---|---|---|
| CA | 620491 | 5/1961 |

* cited by examiner

*Primary Examiner*—Robert E. Pezzuto
*Assistant Examiner*—Alexandra K. Pechhold
(74) *Attorney, Agent, or Firm*—Aikins, Macaulay & Thorvaldson LLP; Murray E. Thrift

(57) ABSTRACT

A grader vehicle has a vehicle body mounted on two drive tracks. A boom is mounted on the front of the vehicle and extends to the front of the body. A third drive track is mounted on the leading end of the boom by a steering mechanism for rotation about an upright steering axis. The three tracks are driven by separate hydraulic motors. The use of a steering, driven track on the boom provides a tractive force pulling the vehicle forwards in the desired direction of travel and positively driving the leading end of the boom in the direction of a turn. The track also provides a degree of packing at the center of the vehicle's path that can not be achieved with a ski gliding on the surface. This is of particular importance when packing ski trails with the vehicle. For grading purposes, the vehicle has a grader blade across the front of the vehicle and a second blade leading the front track. This provides both grading and packing at the center of the track where prior art tracked vehicles would at most provide a grading action with a scraper blade.

9 Claims, 8 Drawing Sheets

SNOW OR SOIL GRADER

FIELD OF THE INVENTION

The present invention relates to an off-road vehicle and more particularly to a vehicle suitable for use as a grader on soft, low density surfaces, for example snow or loose soil.

BACKGROUND

A grader attachment for use on a tracked snow vehicle is disclosed in Eskelson et al. U.S. Pat. No. 3,616,557, issued Apr. 18, 1972. That attachment includes a scraper blade across the front of the vehicle and a boom pivotally mounted on the vehicle to extend to the front, beyond the scraper blade. A ski is mounted on the end of the boom to support the boom and the vehicle. In preferred versions of this attachment, the ski is steerable to limit the requirement for skid steering of the vehicle.

The present invention relates to certain improvements in graders for use on soft services.

SUMMARY

According to the present invention there is provided a vehicle comprising:

a vehicle body;

two endless drive track assemblies mounted on opposite sides of the body;

an elongate boom mounted on the body and extending in a forwards direction from the body;

a third endless drive track assembly;

a steering mechanism mounting the third endless drive track assembly on the boom, spaced forwardly from the body, for rotation about an upright steering axis; and drive means for driving each of the drive track assemblies.

The use of a steering, driven track on the boom provides a tractive force pulling the vehicle forwards in the desired direction of travel and positively driving the leading end of the boom in the direction of a turn. This distinguishes from relying on the reactive force of the surface material on a passive keel imbedded in the surface, as in the prior art. The track also provides a degree of packing at the center of the vehicle's path that can not be achieved with a ski gliding on the surface. This is of particular importance when packing trails with the vehicle. The track also allows the use of the vehicle on surfaces where the friction generated by engagement with a ski would make the ski arrangement unusable.

In preferred embodiments of the vehicle, the vehicle tracks are supported on the vehicle by walking beam suspensions and the boom is fixed to the vehicle. This provides a three point support for the vehicle that maintains vehicle stability and good engagement of the tracks on the surface without resorting to the use of an hydraulic boom control.

For grading purposes, the vehicle has a grader blade across the center of the vehicle and a second blade leading the front track. This provides both grading and packing at the center of the track where prior art tracked vehicles would at most provide a grading action with a scraper blade.

It is preferred that the leading blade have an hydraulic lift system for positioning the blade vertically with respect to the leading track. It is also preferred that the second blade can be angled from side to side to provide a camber on the surface being graded and angled with respect to the direction of travel. This provides full flexibility in grading a surface, including the ability to place soil or snow to one side or other of the vehicle's path.

The invention will now be described by reference to an exemplary embodiment of the invention. It is to be understood that the invention is not limited to that embodiment but may include many others.

BRIEF DESCRIPTION OF THE DRAWINGS

In the accompanying drawings, which illustrate an exemplary embodiment of the present invention.

DETAILED DESCRIPTION

Figure 1:
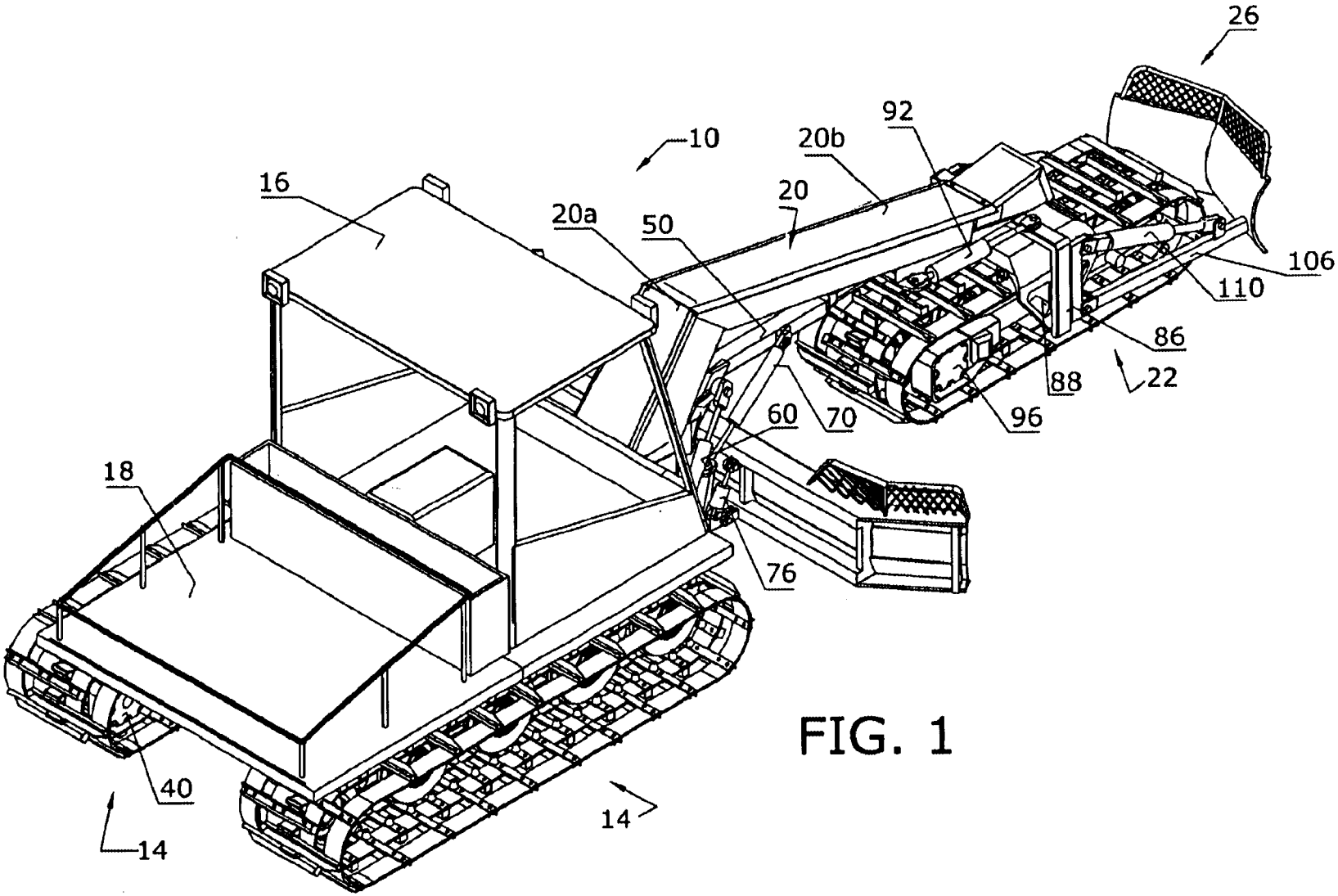
FIG. 1 is an isometric view from the back and right hand side of a vehicle according to the present invention.

Referring to the accompanying drawings, there is illustrated a grader vehicle 10 with a chassis 12 mounted on two vehicle track assemblies 14. The chassis carries a cab 16 and a cargo deck 18 to the rear of the cab. The vehicle engine and hydraulic system are mounted on the chassis beneath the cab and cargo deck.

Fixed to the vehicle chassis and extending forwardly from the center of the vehicle is a gooseneck boom 20 with a short, upwardly inclined rear section 20*a* and a forward section 20*b*. The forward section carries, at its front end, a front track assembly 22.

For grading purposes, the vehicle carries a grader blade 24 across the center of the vehicle and below the boom 20. The boom carries a second, front scraper blade 26 across the front end of the front track assembly 22.

Figure 2:
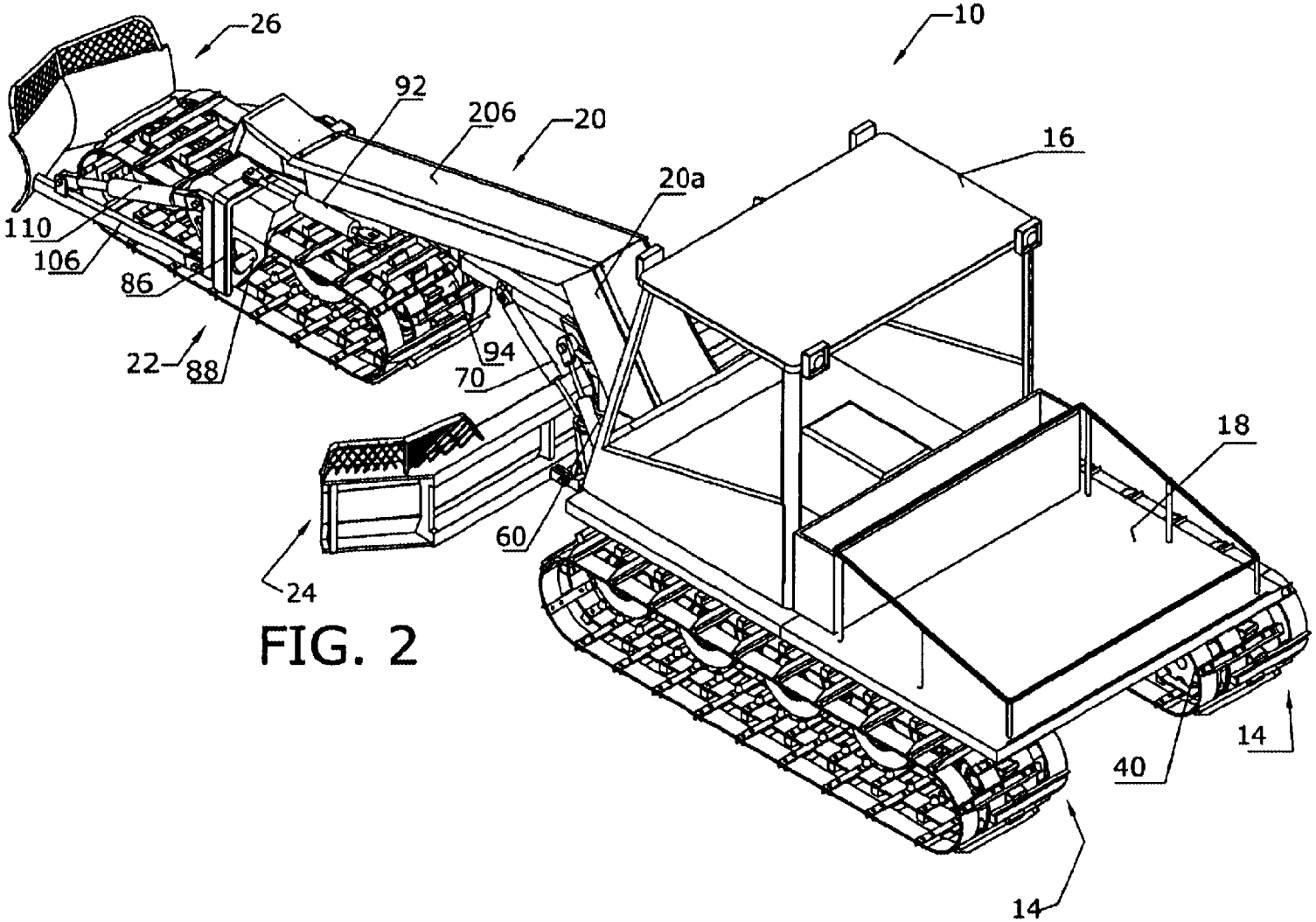
FIG. 2 is an isometric view from the front and the left side of the vehicle of FIG. 1.
Figure 3:
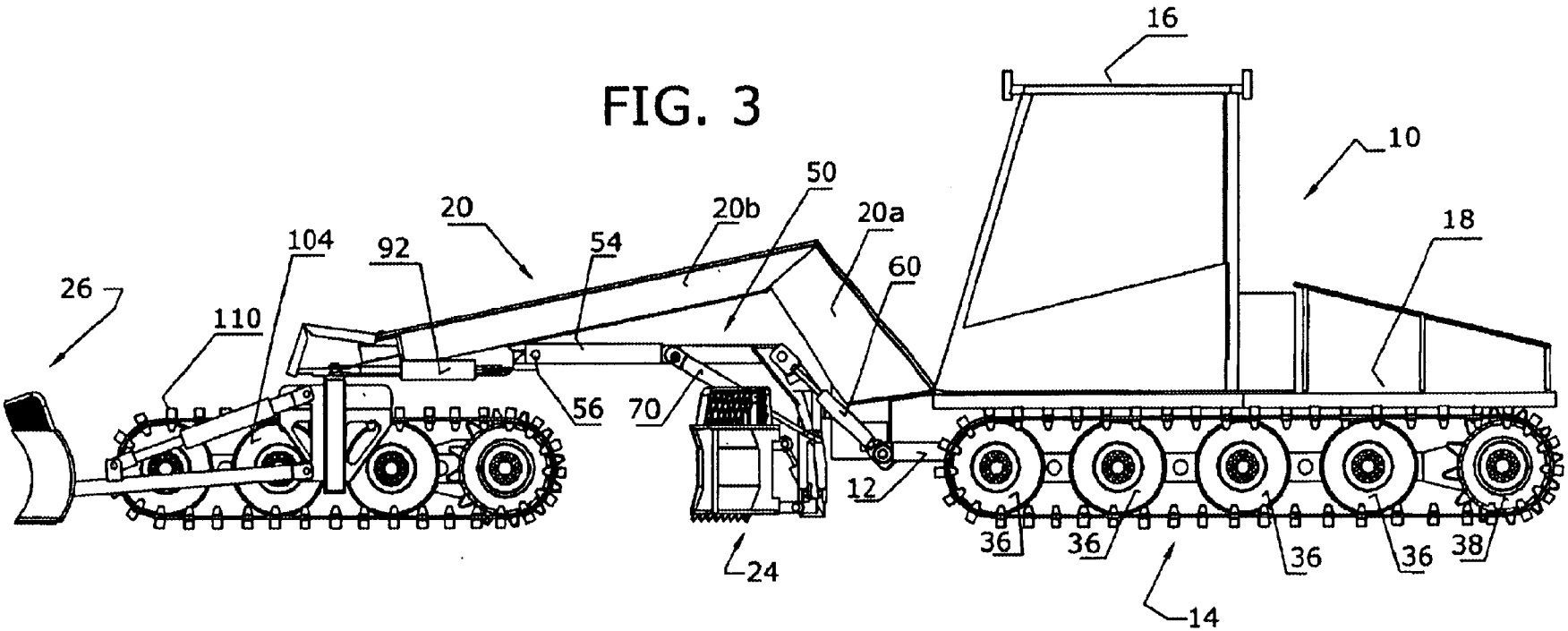
FIG. 3 is a side view of the vehicle.
Figure 5:
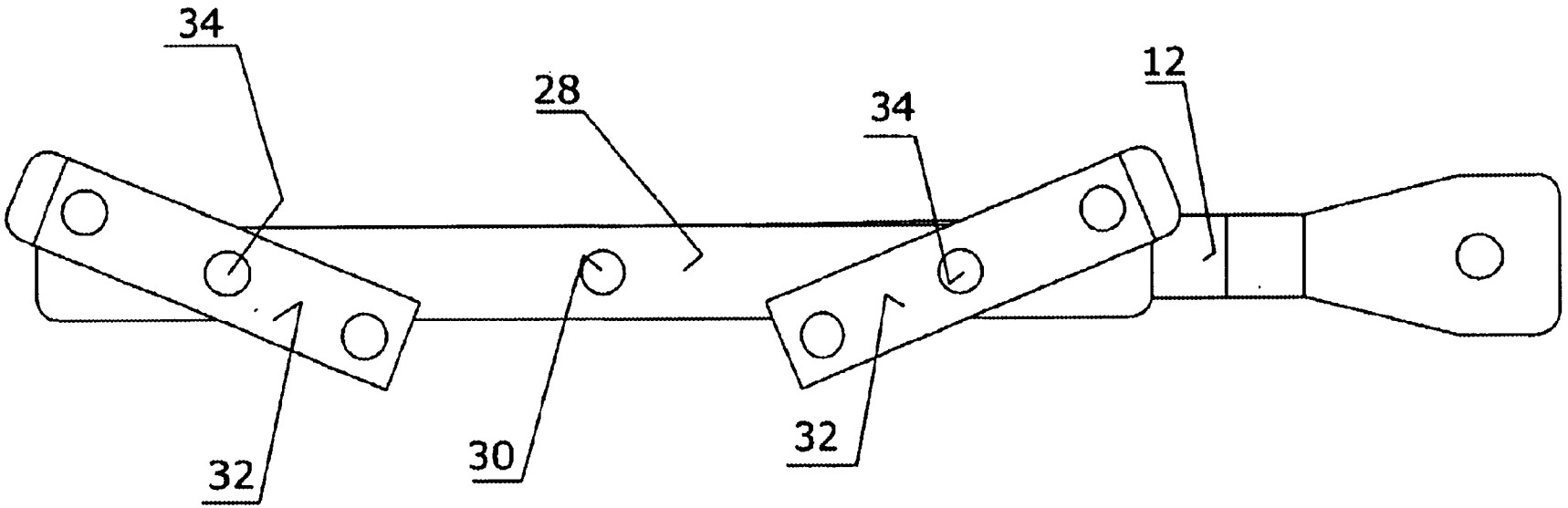
FIG. 5 is a detail of the rear track suspension.

Each of the vehicle track assemblies 14 is mounted on a walking beam assembly illustrated most particularly in FIG. 5. This includes a main walking beam 28 mounted on an axle 30 at the center and two secondary walking beams 32 mounted on the main walking beam 28 by respective axles 34. Each of the secondary walking beams 32 carries two support wheels 36 (FIG. 3), for a total of four support wheels for each track. At the rear of the track, mounted on the main walking beam 28, is an hydraulic motor 40 (FIGS. 1 and 2). A drive sprocket 38 is attached to the motor and engages the track.

Figure 7:
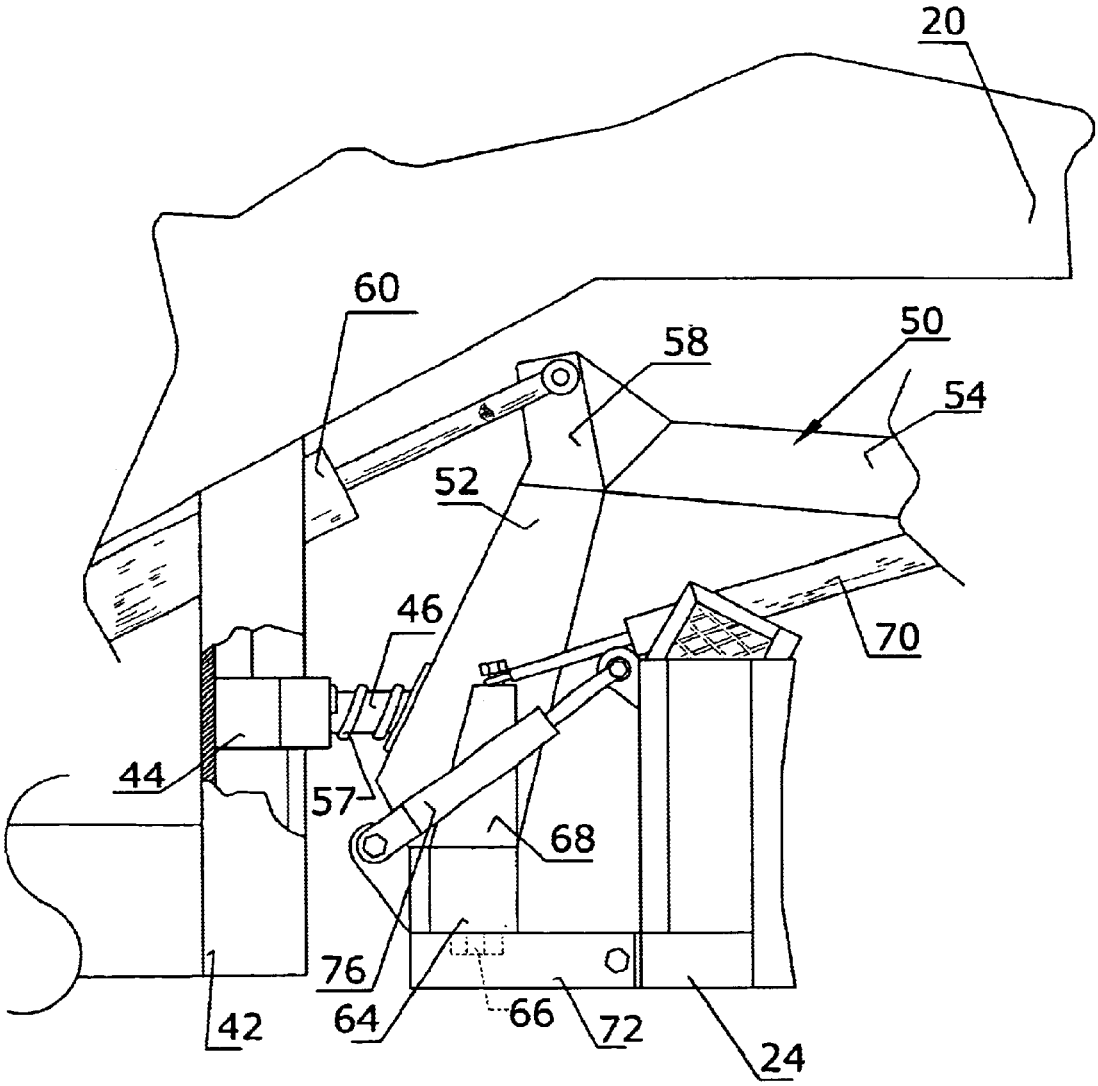
FIG. 7 is a detail side elevation of the support for the grader blade at the front of the vehicle.
Figure 9:
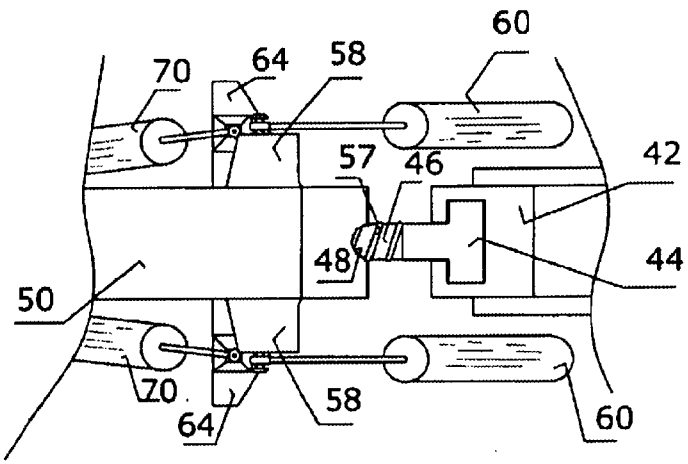
FIG. 9 is a detail plan view showing the blade elevating mechanism.
Figure 8:
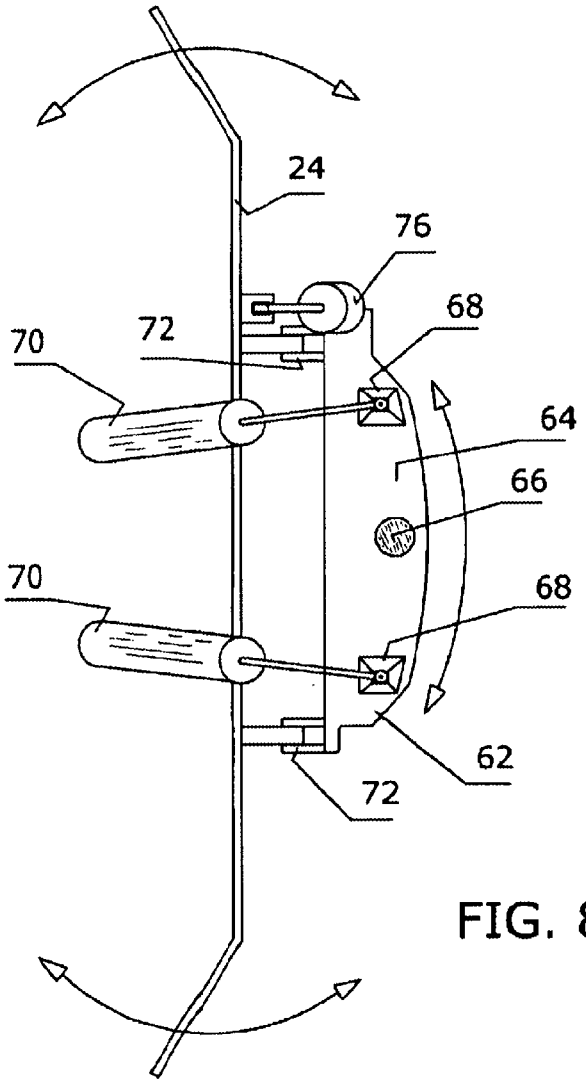
FIG. 8 is a partial plan view of the grader blade support showing the mechanism for angling the blade with respect to the direction of travel.

As illustrated most particularly in FIGS. 7 and 9, the chassis of the vehicle carries an upright track 42 at the front, center of the chassis. A track follower 44 slides vertically in this track. A shaft 46 projects forwardly from the follower into an aperture 48 in the back side of a gooseneck beam 50. The beam 50 has an upright rear section 52 and an elongate forward section 54 extending to a universal joint 56 (FIG. 3) mounted on the bottom side of the boom 20 above the front track assembly 22. A spring 57 is fitted onto the shaft 46 between the track 42 and the rear section 52 of the beam 50 to allow variable spacing of the beam from the track.

At the junction between the rear section 52 and the forward section 54 of the beam 50 are two lugs 58. These project outwardly to clear the boom 20 and are pivotally connected to the rod ends of two lift cylinders 60 connected in turn to the vehicle chassis. Extension and contraction of the lift cylinders raises and lowers the rear end of the beam 50 as its front end pivots on the universal joint 56. Differential extension of the two cylinders 60 will cause a rolling motion of the beam, twisting about the universal joint 56 and the shaft 46.

A lower blade mount 62 is mounted on the bottom end of the rear section 52 of the beam 50. It includes a cross beam 64 that extends across the bottom of the beam and is connected to it by an upright pivot 66. The cross beam 64 carries two upright standards 68 on opposite sides of the beam 50. These are pivotally connected to the rod ends of two hydraulic cylinders 70 that extend forwardly and have their cylinder ends connected to appropriate fittings on the beam 50. Differential actuation of these two cylinders will rotate the blade mount 62 about the upright pivot 66.

Two lugs 72 project forwardly from the bottom of the cross beam 64 adjacent opposite ends of the cross beam and are pivotally connected to lugs mounted on the back side of the grader blade 24 to allow the grader blade to pivot about a lateral axis perpendicular to the upright pivot 66. A cylinder 76 has its rod end pivotally connected to a pair of lugs on the back side of the grader blade 24 at the top of the grader blade. The cylinder end of the cylinder 76 is pivotally connected to a lug on the back side of the cross beam 64. Extension and contraction of the cylinder 76 controls the upright angle of the grader blade 24.

Figure 4:
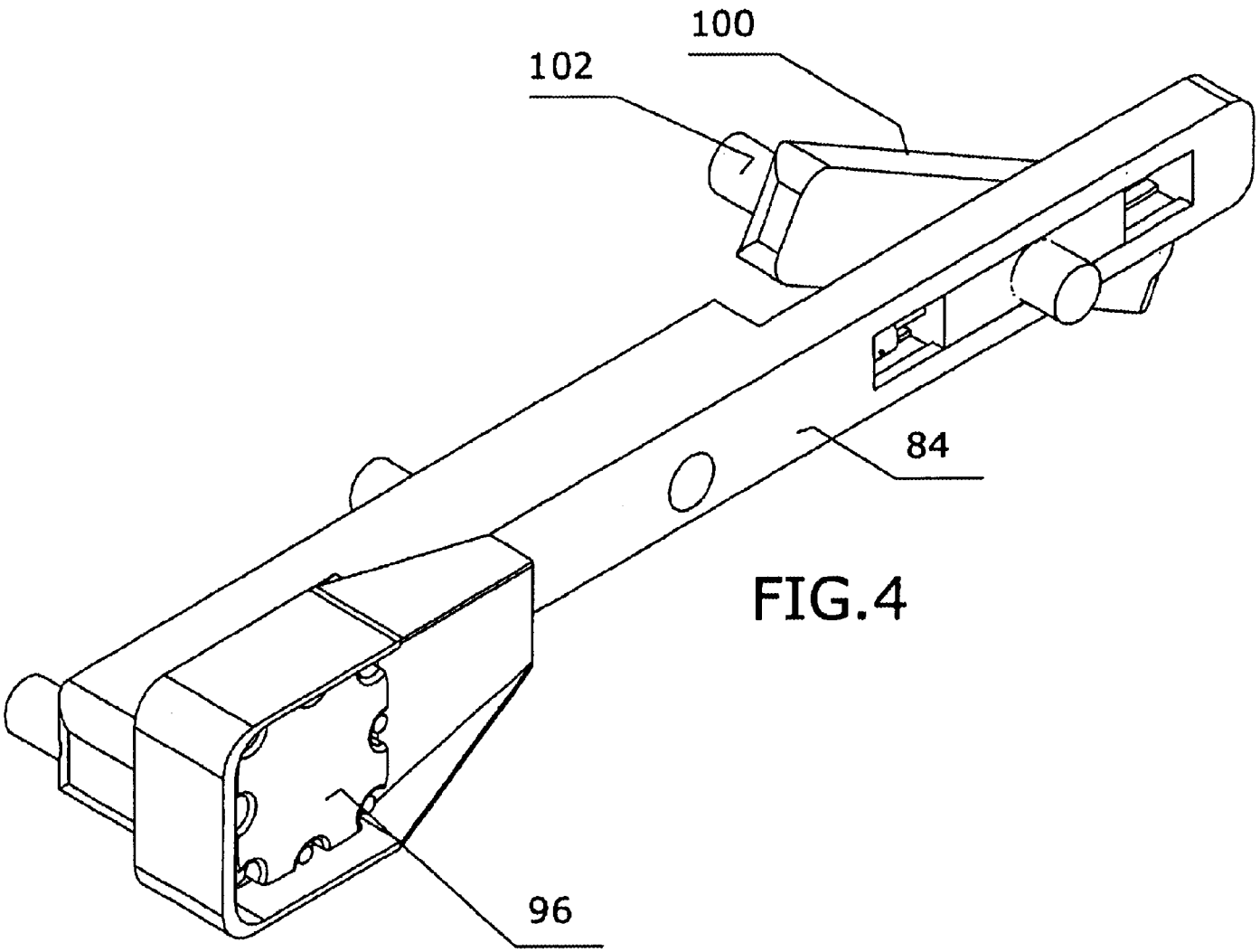
FIG. 4 is a detail of the front track suspension.
Figure 6:
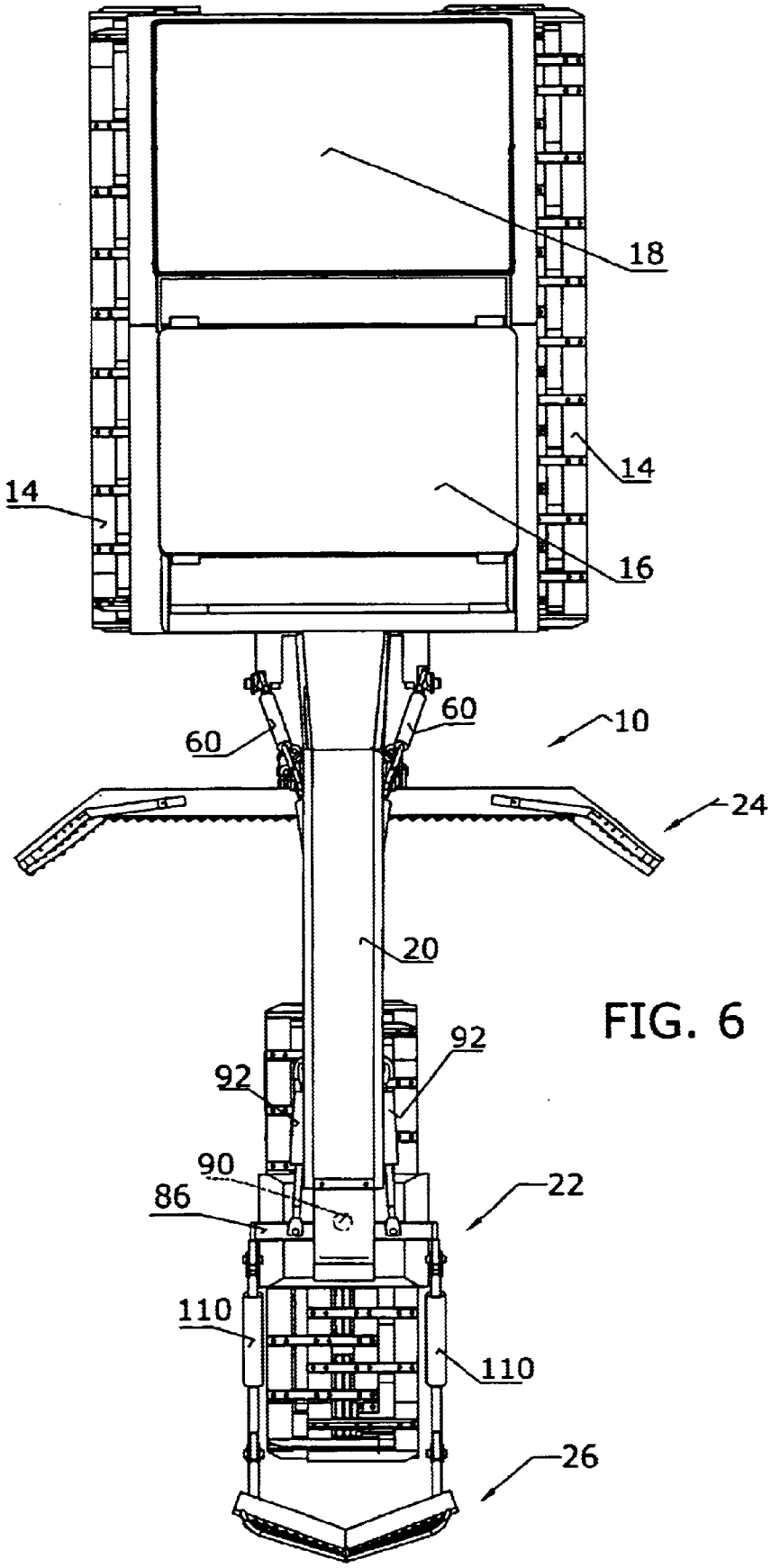
FIG. 6 is a plan view of the vehicle.

The front track assembly 22 includes a main beam 84 (FIG. 4) that is pivotally mounted at its center on a yoke 86 extending across the top of the track. An axle 88 extends from side to side to mount the beam on the yoke. The yoke is in turn pivotally mounted on the leading end of the boom 20 by an upright pivot 90 (FIG. 6). Two steering cylinders 92 are mounted on opposite sides of the boom 20, with their cylinder ends connected to the boom and their rod ends connected to the yoke so that the front track assembly 22 can be turned about the upright pivot 90.

A drive sprocket 94 is connected to the drive shaft of an hydraulic motor 96, which is mounted on the back end of the beam 84. In front of the sprocket 94 is a wheel 98 rotatably mounted on the beam 84. A walking beam 100 is pivotally mounted on the beam at the front end. It carries two axles 102 which carry respective wheels 104. The front track 105 is entrained about the sprocket 94 and wheels 98 and 104. The walking beam suspension of the two front wheels allows the track some flexibility in riding over obstacles that are encountered as the vehicle traverses the ground surface.

Two support arms 106 are pivotally mounted on the yoke 86 and project forwardly to the front scraper 26. Lift cylinders 110 connect the support arms 106 and the yoke 86 on opposite sides of the track and serve to vertically position the front scraper blade 26.

In use of the vehicle, the front track is used for both traction and steering. On soft surfaces it also provides compaction at the center of the path being traversed. The main grader blade 24 can be positioned at any angle relative to the direction of travel. It may also be inclined from side to side and raised and lowered as desired.

Since steering is provided by the front track, skid steering using the vehicle track assembly 14 is not required and these can both be driven at the same speed.

While one embodiment of the present invention has been described in the foregoing, it is to be understood that other embodiments are possible within the scope of the invention. The invention is to be considered limited solely by the scope of the appended claims.

Embodiments of the invention in which an exclusive property or privilege is claimed are defined as follows:

1. A vehicle comprising:

a vehicle body;

two endless drive track assemblies mounted on opposite sides of the body;

an elongate boom mounted on the body and extending in a forwards direction from the body;

a third endless drive track assembly;

a scraper blade positioned between the third track assembly and the vehicle body;

a steering mechanism mounting the third endless drive track assembly on the boom, spaced forwardly from the body, for rotation about an upright steering axis; and drive means for driving each of the drive track assemblies.

2. A vehicle according to claim 1 wherein the boom is immovably fixed to the vehicle body and each of the two endless drive track assemblies mounted on the body includes a walking beam suspension.

3. A vehicle according to claim 1 including a leading scraper blade mounted on the boom at a position leading the third track assembly.

4. A vehicle according to claim 3 including means for raising and lowering the leading scraper blade.

5. A vehicle according to claim 4 wherein the leading scraper blade is mounted on the third track assembly for steering movement therewith.

6. A vehicle according to claim 1 including means for raising and lowering the scraper blade.

7. A vehicle according to claim 6 including means for turning the scraper blade about an upright axis relative to the vehicle body.

8. A vehicle according to claim 7 including means for tilting the scraper blade from side to side.

9. A vehicle according to claim 1 wherein the drive means comprise hydraulic motors for the respective tracks.

* * * * *